US006375099B1

(12) United States Patent
McGuffey

(10) Patent No.: US 6,375,099 B1
(45) Date of Patent: Apr. 23, 2002

(54) SPLIT OUTPUT ADHESIVE NOZZLE ASSEMBLY

(75) Inventor: Grant McGuffey, Springfield, TN (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/598,166

(22) Filed: Jun. 21, 2000

(51) Int. Cl.[7] ..... B05B 1/14

(52) U.S. Cl. ..... 239/553.5; 239/124; 239/296; 239/135; 239/590.5; 239/596

(58) Field of Search ..... 239/553.5, 553, 239/553.3, 124, 128, 135, 290, 292, 296, 390, 391, 418, 552, 590.3, 590.5, 596; 118/411, 412; 156/578; 425/7, 72.2, 382, 463, 46, 570

(56) References Cited

U.S. PATENT DOCUMENTS 3,204,290 A * 9/1965 Crompton ..... 425/462
3,492,692 A * 2/1970 Soda et al. ..... 425/463
3,758,252 A * 9/1973 Kohler ..... 425/570
5,478,224 A * 12/1995 McGuffey ..... 425/7
5,562,930 A * 10/1996 Hills ..... 425/382
5,740,963 A * 4/1998 Riney et al. ..... 239/553

* cited by examiner

*Primary Examiner*—Lesley D. Morris
*Assistant Examiner*—Dinh Q. Nguyen
(74) *Attorney, Agent, or Firm*—Schwartz & Weinrieb

(57) ABSTRACT

A hot melt adhesive dispensing nozzle or die assembly spans two adjacent adhesive material valved inlets. One of the valved inlets is blocked off by means of the nozzle or die assembly, while the other adhesive material input or valved inlet is in effect split into two equal laterally separated output arrays of dispensing nozzles so as to provide for a void in the dispensing or deposition pattern at a predeterminedly desired location. The nozzle or die assembly comprises unique structure for ensuring that the hot melt adhesive material is able to be conducted to the remote one of the laterally separated array of dispensing nozzles. In addition, the two laterally separated arrays of output dispensing nozzles together comprise the same number of conventional non-split output dispensing nozzles operatively associated with each adhesive material input or valved inlet such that the volume flow rate through each one of the individual dispensing nozzles remains the same. In this manner, the aforenoted pattern void is achieved while preserving the desired ratio of heated air to adhesive material whereby the hot melt adhesive material being dispensed retains its proper fluidic properties, and undue waste of the adhesive material is not incurred.

30 Claims, 4 Drawing Sheets

SPLIT OUTPUT ADHESIVE NOZZLE ASSEMBLY

FIELD OF THE INVENTION

The present invention relates generally to hot melt adhesive dispensing nozzle assemblies, and more particularly to a new and improved multi-plate split output hot melt adhesive nozzle assembly wherein in order to create an output or dispensing void within a particular resulting dispensed pattern in accordance with required or desired distribution or application parameters, the output flow from a first adhesive supply module is in effect blocked off while the output flow from a second adjacent adhesive supply module is effectively split into two equally distributed output supplies and conducted to two laterally separated nozzle arrays.

BACKGROUND OF THE INVENTION

Multi-plate dispensing nozzle assemblies for dispensing, for example, hot melt adhesive fluid streams, are well known in the art and are exemplified by means of U.S. Pat. No. 6,051,180 which issued to Kwok on Apr. 18, 2000, U.S. Pat. No. 5,904,298 which issued to Kwok et al. on May 18, 1999, U.S. Pat. No. 5,902,540 which issued to Kwok on May 11, 1999, U.S. Pat. No. 5,882,573 which issued to Kwok et al. on Mar. 16, 1999, and U.S. Pat. No. 5,862,986 which issued to Bolyard, Jr. et al. on Jan. 26, 1999, the disclosures of which are incorporated herein by reference. As can be seen from the noted prior art patent publications, particularly U.S. Pat. No. 5,904,298, dual-component hot melt adhesive fluid streams are able to be dispensed from a plurality of nozzle members or orifices which are fluidically connected to adjacent supply valves which receive the adhesive fluid streams from a common manifold or head. The nozzle members or orifices are uniformly arranged in a lateral or transverse array extending across the lateral or transverse extent of the dispensing dies or nozzle assemblies. Sometimes, however, in lieu of the dispensing nozzle members or orifices being arranged across the lateral or transverse extent of a particular dispensing die or nozzle assembly in a single uniform essentially continuous array, and in order to satisfy or meet particular adhesive deposition pattern requirements or application parameters, it is desired to in effect dispense the adhesive fluid streams in laterally separated streams or sets of streams wherein, in effect, a void is defined between the separated streams or sets of streams.

One conventional manner in which such a void can be provided or defined has been to mount half-nozzle assemblies upon the adjacent supply valves. More particularly, a left-handed half-nozzle assembly is mounted upon, for example, a left supply valve, while a right-handed half-nozzle assembly is mounted upon a right supply valve, whereby the void is then defined, in effect, by means of the blocked or inoperative half-nozzle assembly nozzle members or orifices defined between the active or operative half-nozzle assembly nozzle members or orifices. The operational disadvantage of such a system, however, is that the supply of the adhesive fluid stream to the supply valves from the common manifold or head is provided by means of a constant-output metering gear pump which outputs a predetermined amount of adhesive material which is designed to be dispensed through means of a predetermined number of dispensing nozzle members or orifices.

Accordingly, if the predetermined amount of adhesive material is conveyed to the half-nozzle assemblies so as to be dispensed thereby, then each half-nozzle assembly, now comprising only one half of the normal number of dispensing nozzle members or orifices characteristic of the normal or conventional full dispensing nozzle assembly, would have to, in effect, still dispense the same or normal or predetermined amount of the adhesive material as would normally be dispensed by means of the complete or full nozzle assembly. Considered from a slightly different viewpoint, or in other words, each nozzle member or orifice of each half-nozzle assembly would now be dispensing twice the normal or predetermined amount of adhesive material that would normally be dispensed by each individual nozzle member or orifice of the complete or full nozzle assembly. It is also to be remembered that the adhesive material is conventionally mixed with, for example, heated air in the well-known manner so as to provide the adhesive-air mixture with the proper fluidic properties. Accordingly, in view of the increased volume of adhesive being dispensed by means of each nozzle member or orifice of each half-nozzle assembly, the ratio of adhesive material to the heated air would now then be twice the normal ratio of adhesive to heated air whereby the resulting adhesive fluid stream may not in fact be sufficiently fluid so as to permit the dispensing of the same. Alternatively, if the resulting adhesive fluid stream is in fact sufficiently fluid so as to permit the dispensing of the same, twice the amount of adhesive material would be continuously dispensed and used whereby significant waste and excessive costs would be incurred. In addition, it must also be further appreciated that the volume or amount of adhesive material conveyed or conducted to the individual nozzle members or orifices cannot be simply reduced because, as has been noted, the adhesive material is supplied to the half-nozzle assemblies by means of a constant-output metering gear pump which outputs the aforenoted predetermined amount of adhesive material.

A need therefore exists in the art for a new and improved multi-plate split output hot melt adhesive nozzle assembly which is able to, in effect, split the supplied adhesive material into two laterally separated streams or sets of streams of adhesive material, so as to provide a void therebetween in accordance with required or desired dispensing patterns or application parameters, without altering the volume of the adhesive material being dispensed per unit of time such that, in turn, the ratio of the adhesive material with respect to the heated air fluid streams with which the adhesive material is mixed is not altered whereby the resulting adhesive material filaments or streams are able to be provided with the proper or desired fluidic properties so as to in fact facilitate the deposition or dispensing of the adhesive material.

OBJECTS OF THE INVENTION

Accordingly, it is an object of the present invention to provide a new and improved multi-plate hot-melt adhesive nozzle assembly.

Another object of the present invention is to provide a new and improved multi-plate hot-melt adhesive nozzle assembly which is able to rectify the problems characteristic of the PRIOR ART.

An additional object of the present invention is to provide a new and improved multi-plate hot-melt adhesive nozzle assembly which is able to in effect block off a first supply valve inlet or module and to split the adhesive material input provided to a second supply valve inlet or module into two substantially equal or balanced laterally separated adhesive material outputs for dispensing by means of two laterally separated sets of nozzle members or orifices such that a void in the dispensing pattern can be achieved as desired or required in connection with pattern or application requirements or parameters.

A further object of the present invention is to provide a new and improved multi-plate split-output hot-melt adhesive nozzle assembly which is able to in effect block off a first supply valve inlet or module and to split the adhesive material input provided to a second supply valve inlet or module into two substantially equal or balanced laterally separated adhesive material outputs for dispensing by means of two laterally separated sets of nozzle members or orifices such that a void in the dispensing pattern can be achieved as desired or required in connection with pattern or application requirements or parameters without altering the ratio of the adhesive material with respect to the heated air, with which the adhesive material is normally mixed, whereby the fluidic properties of the resulting adhesive material-heated air mixture remain unchanged with respect to the fluidic properties of conventionally dispensed adhesive material-heated air mixtures so as to permit the resulting adhesive material-heated air mixture to be readily dispensed and in a cost-effective manner such that adhesive material supplies are not wasted.

SUMMARY OF THE INVENTION

The foregoing and other objectives are achieved in accordance with the teachings and principles of the present invention through the provision of a new and improved multi-plate split output hot-melt adhesive nozzle or die assembly which is able to be mounted upon an adhesive supply manifold or head such that the nozzle or die assembly is fludically connected to a pair of adjacent adhesive supply conduits or valved inlets. A first plate of the multi-plate nozzle or die assembly effectively blocks off one of the pair of adjacent adhesive supply conduits or valved inlets, while the remaining plates of the multi-plate nozzle or die assembly split the adhesive material supplied from the other one of the pair of adjacent adhesive supply conduits or valved inlets into two adhesive flows and convey, conduct, and equally distribute such split adhesive material flows to a pair of laterally separated sets or arrays of dispensing nozzle members or orifices wherein each separated set or array of dispensing nozzle members or orifices comprises a predetermined number of dispensing nozzle members or orifices.

In this manner, as desired or required in connection with particular adhesive material dispensing patterns or application requirements or parameters, a void is defined between the laterally separated sets or arrays of dispensing nozzle members or orifices, and yet, since the two laterally separated sets or arrays of dispensing nozzle members or orifices together comprise the same predetermined number of dispensing nozzle members or orifices as that of a conventional set or array of non-separated nozzle members or orifices, the two flows of adhesive material dispensed from the two laterally separated sets or arrays of dispensing nozzle members or orifices comprise the same volume of adhesive material as would normally be dispensed from the second unblocked supply conduit or valved inlet. Accordingly, the ratio of adhesive material with respect to the mixed heated air remains the same whereby the fluid properties of the resulting adhesive material-air mixture remain the same such that the adhesive material can in fact be readily dispensed. In addition, the supply of adhesive material is utilized in a cost-efficient manner.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figures 1, 2:
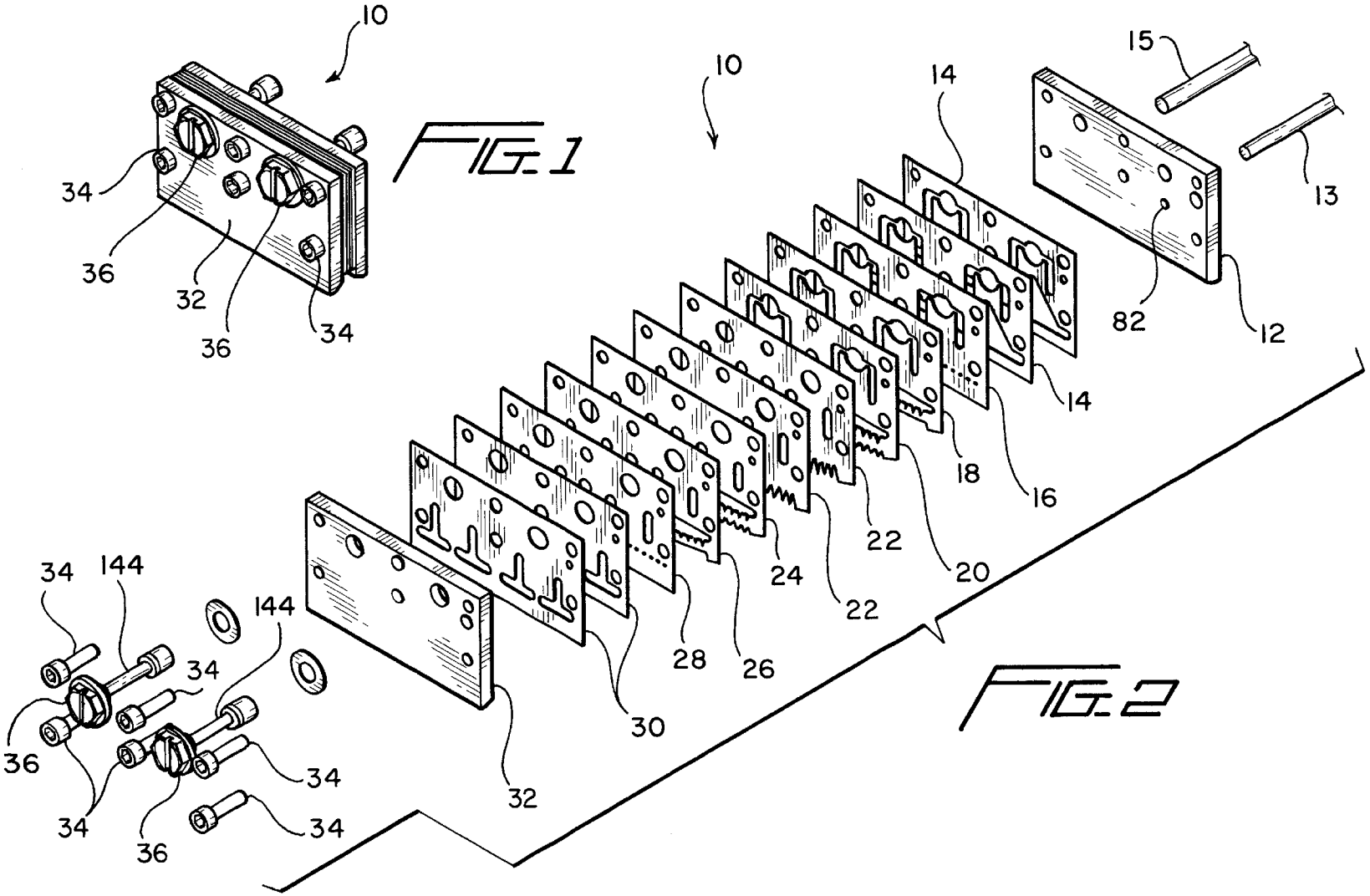
FIG. 1 is a perspective view of a new and improved multi-plate split output hot-melt adhesive nozzle or die assembly as constructed and assembled together in accordance with the principles and teachings of the present invention.
FIG. 2 is an exploded perspective view of the new and improved multi-plate split output hot-melt adhesive nozzle or die assembly as shown in FIG. 1 and partially showing the individual plates comprising the multi-plate split output hot-melt adhesive nozzle or die assembly shown in FIG. 1.

Referring now to the drawings, and more particularly to FIGS. 1,2, and 3*a*–3*k* thereof, a new and improved multi-plate split output hot-melt adhesive nozzle or die assembly constructed in accordance with the principles and teachings of the present invention is illustrated and is generally indicated by the reference character 10. More particularly, as generally seen in FIGS. 1 and 2, the new and improved multi-plate split output hot-melt adhesive nozzle or die assembly 10 is seen to comprise a plurality of nozzle or die plates 12–32 which are adapted to be fixedly secured together by means of a plurality of fasteners 34 and screw bolts 36. Plate 12 comprises an interior assembly cover plate, plate 32 comprises an exterior assembly cover plate, and the remaining plates 14–30 comprise fluid control plates for controlling or determining the flow of the hot melt adhesive and heated air fluids to be conducted through the nozzle or die assembly 10. Accordingly, it is seen, for example, as may best be appreciated from FIGS. 3*a*–3*k* for clarity purposes, that the plate 12 is provided with a plurality of first apertures 38 for accommodating the plurality of fasteners 34 wherein the apertures 38 are disposed within the upper and lower corner regions of the plate 12 as well as upper and lower central regions of the plate 12, and a plurality of second apertures 40 for accommodating the plurality of screw bolts 36 wherein the apertures 40 are disposed within upper regions of the plate 12 between the upper corner and upper central apertures 38. In a similar manner, each one of the plates 14–32 is respectively provided with a plurality of similarly located first apertures 42–60 for accommodating the plurality of fasteners 34, and a plurality of similarly located second apertures 62–80 for accommodating the plurality of screw bolts 36.

In accordance with the primary objective of the present invention, it is desired to develop a hot melt adhesive nozzle or die assembly for dispensing or depositing hot melt adhesive onto a substrate in accordance with a particularly desired or required pattern wherein, for example, a void in the pattern is to be provided at a particular or specified location. Furthermore in accordance with the foregoing, such primary objective is to be achieved in effect by altering, re-routing, repositioning, or relocating the disposition of the individual nozzles or orifices of the nozzle or die assembly from which the individual flows of hot melt adhesive are to be dispensed such that the aforenoted pattern of hot melt adhesive, containing the desired void therewithin, is in fact achieved. More particularly and still further, such pattern must be achieved by maintaining the adhesive stream output volume issuing from each repositioned, re-routed, or relocated individual nozzle or orifice the same as, or constant with respect to, the hot melt adhesive stream output volume issuing from each individual orifice or nozzle of a conventional unaltered hot melt adhesive nozzle or die assembly. Accordingly, pursuant to one of the major or unique features of the present invention, the hot melt adhesive nozzle or die assembly constructed in accordance with the principles and teachings of the present invention is adapted to in effect span two adjacent adhesive material outputs, supply conduits, or valved inlets, and to block off one of such outputs, supply conduits, or valved inlets, while permitting adhesive material to flow from the second one of the two adjacent adhesive material outputs, supply conduits, or valved inlets. In addition, the lateral array of individual nozzle or orifices normally or conventionally fluidically connected to the second one of the two adjacent adhesive material outputs, supply conduits, or valved inlets, and comprising a predetermined number of individual nozzles or orifices, is divided in effect, and as an example, into two equal laterally separated arrays of nozzles or orifices such that each laterally separated array now comprises one-half the number of the previously undivided conventionally provided array of nozzles or orifices.

In this manner, the desired pattern void is defined between the laterally separated arrays of nozzles or orifices. In addition, since the number of individual nozzles or orifices defined within the two laterally separated arrays of nozzles or orifices is the same as the number of individual nozzles or orifices contained within the original or conventional undivided or non-separated lateral array of nozzles or orifices, the volume flow rate of adhesive material issuing from each one of the individual nozzles or orifices contained within each one of the two laterally separated arrays of nozzles or orifices is the same as the volume flow rate of each nozzle or orifice of the original or conventional non-separated or undivided lateral array of nozzles or orifices.

Figure 3A:
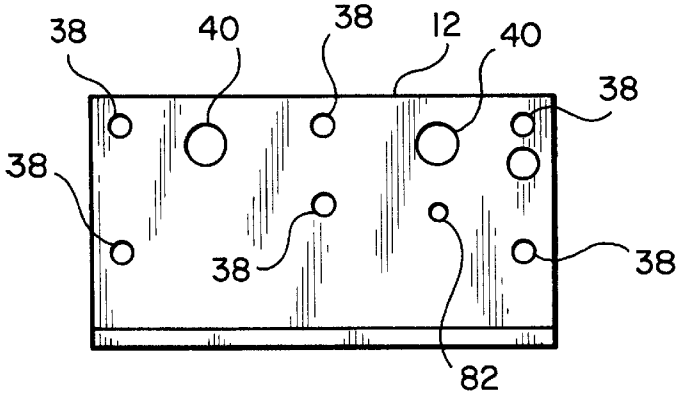
FIGS. 3*a*–3*k* are enlarged front elevational views of the individual plates of the new and improved multi-plate split output hot-melt adhesive nozzle or die assembly, as shown in FIG. 2, which clearly illustrate the details of the various individual plates constructed in accordance with the principles and teachings of the present invention and showing the cooperative parts thereof so as to more easily disclose the particular fluid flows defined by such plates in order to achieve the particular adhesive dispensing objectives or patterns of the present invention.

More particularly, then, it can be appreciated from FIGS. 2 and 3*a* that in accordance with the principles and teachings of the present invention, and with respect to the routing or conveyance of the hot melt adhesive material through the nozzle or die assembly 10, the first or interior cover plate 12 of the nozzle or die assembly 10 has a predetermined width, as do the other remaining plates 14–32 of the nozzle or die assembly 10, which is adapted to span a pair of adjacent hot melt adhesive material outputs, supply conduits, or valved inlets, shown at 13,15, and that the first or interior cover plate 12 of the hot melt adhesive nozzle or die assembly 10 is provided with an aperture 82 which is provided within a right side portion of the plate 12 as viewed, for example, in FIG. 3*a*. Aperture 82 is adapted to be fluidically connected to a first one of the aforenoted pair of adjacent hot melt adhesive material outputs, supply conduits, or valved inlets, shown at 13, so as to receive hot melt adhesive material from the supply manifold or head, not shown, however, it is seen that an aperture corresponding to aperture 82 is not in fact provided within the left side portion of the plate 12, or in other words, the left side portion of the plate 12 is solid. In this manner, the hot melt adhesive fluid flow from the second one of the two adjacent hot melt adhesive material outputs, supply conduits, or valved inlets, shown at 15, is in effect blocked whereby such hot melt adhesive material fluid flow is recirculated by means of structure comprising the constant output gear metering pump, not shown, in a manner which is not part of the present invention.

Figure 3B:
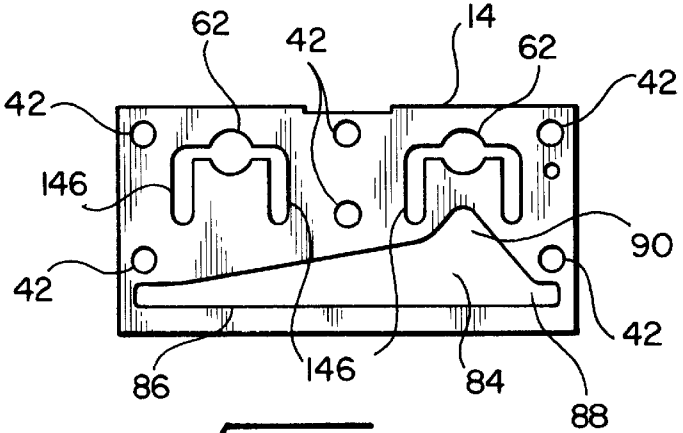

Referring now to FIG. 3*b*, the second plate 14 is seen to be provided with a substantially triangular-shaped aperture 84 wherein the base portion 86 of the triangular-shaped aperture 84 extends substantially entirely across the width of the plate 14 so as to in effect define a laterally extending slot 88 while an upper apex portion 90 of the triangular aperture 84 is provided at an elevation within the plate 14 so as fluidically connected to the aperture 82 of the first cover plate 12. In this manner, hot melt adhesive supplied from the aperture 82 of plate 12 can be distributed through apex portion 90 and triangular portion 84 to the laterally or transversely extending slot portion 88 of the plate 14. It is to be noted that the particular, specific, or precise configuration or geometrical shape of the triangular-shaped aperture 84 is such as to substantially balance or equally distribute the adhesive material to the laterally separated left and right side portions of the plate 14.

Figure 3C:
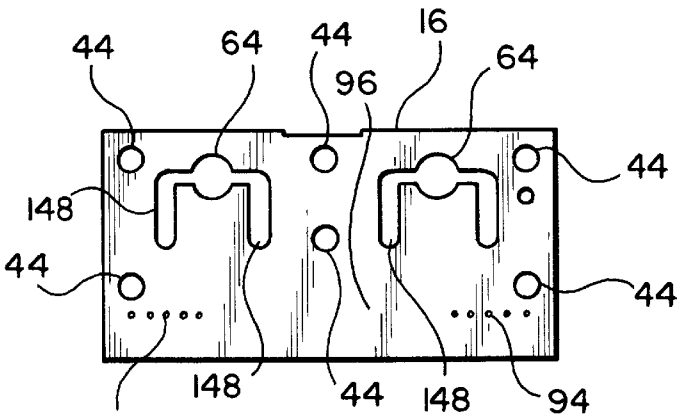

With reference now continuing to be made to FIG. 3*c*, it is seen that the lower region of the third plate 16 is provided with first and second laterally separated left and right side arrays of apertures 92,94 which are adapted to be fluidically connected to the slot 88 of second plate 14. It can be appreciated that in view of the lateral separation of the first and second arrays of apertures 92,94, a central void region 96 is defined therebetween. It is also noted that left side array 92 comprises, for example, five apertures while right side array 94 comprises, for example, four apertures, and again, such a disparity per se in the number of apertures again substantially facilitates the balancing or equalization of the flow of the adhesive material through such arrays of apertures 92,94 and toward the fourth plate 18 in view of the fact that the left side array of apertures 92 is obviously more remote than the right side array of apertures 94 with respect to the origin of flow of the adhesive material from the aperture 82 and apex portion 90 of the first and second plates 12,14, respectively. It is noted still further that the apertures 92,94 also provide a filtering function with respect to the adhesive material conducted therethrough such that predeterminedly sized debris or particles which may be present within the adhesive material are not conducted to the individual downstream dispensing nozzles or orifices.

Figure 3D:
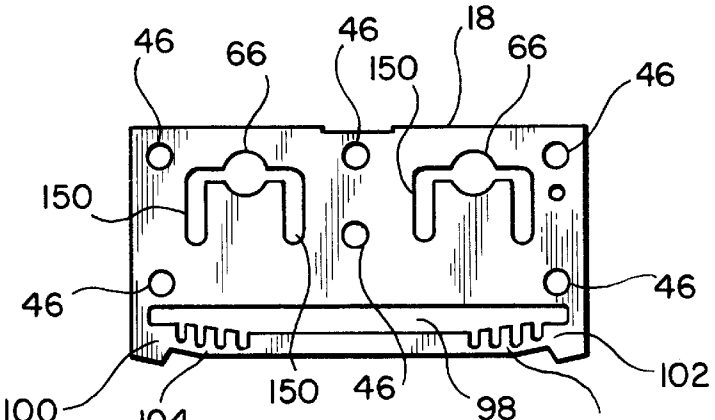

With reference now being made to FIG. 3*d*, it is seen that the lower region of the fourth plate 18 is provided with an elongated slot 98 which spans substantially the entire width of the fourth plate 18, and it is further seen that the lower peripheral edge of the elongated slot 98 is provided with laterally separated left and right side arrays 100,102 of inverted substantially triangular-shaped orifices or apertures 104,106 wherein each array 100,102 of apertures or orifices 104,106 comprises four apertures or orifices. It is to be noted that the provision of the apertures 92,94 defined within third plate 16, as well as the provision of the elongated slot 98 defined within fourth plate 18, together provide the viscous hot melt adhesive material with the proper pressure head parameters and flow properties such that the hot melt adhesive material can in fact continue to flow downstream toward the individual dispensing nozzles or orifices as will be evident shortly hereinafter. As shown in FIG. 3*e*, the fifth plate 20 is seen to be substantially identical to the fourth plate 18 with the exception that a lowermost edge portion 108, containing left and right side arrays 110,112 of additional triangular-shaped apertures or orifices 114,116, is provided in connection with the conveyance or routing of the heated air through the nozzle or die assembly 10 as will be discussed shortly hereinafter, each array 110,112 of apertures or orifices 114,116 comprising five apertures or orifices 114,116. Accordingly, it is thus appreciated that the fifth plate 20 is likewise provided with an elongated slot 118, similar to the slot 98 provided within the fourth plate 18, wherein elongated slot 118 is likewise provided with left and right side arrays 120,122 of inverted substantially triangular apertures or orifices 124, 126 wherein each array 120,122 of apertures or orifices 124, 126 comprises four apertures or orifices 124,126.

Figure 3F:
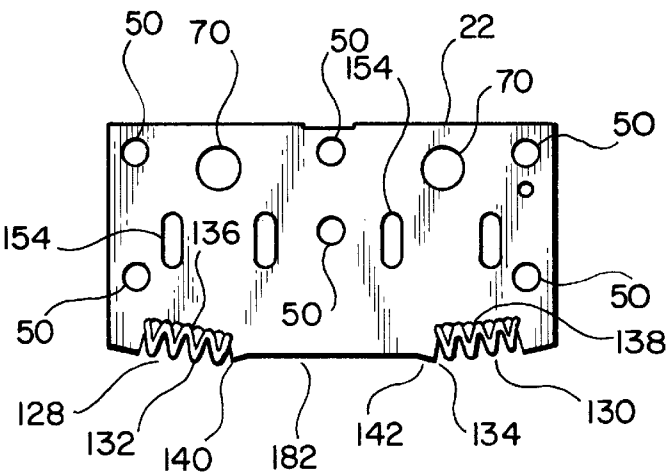

Lastly, in connection with the dispensing, deposition, or discharge of the hot melt adhesive material from the multi-plate nozzle or die assembly 10, the lower region of the sixth plate 22 is seen to comprise two laterally separated arrays 128,130 of adhesive material dispensing nozzles or orifices 132,134 wherein each array 128,130 of the adhesive material dispensing nozzle or orifice portions 132, 134 comprises four adhesive material dispensing nozzles or dispensing orifices 132,134 as seen in FIG. 3*f*. It is important to note or appreciate that the lower ends or apex portions of the apertures or orifices 124,126 are in effect laterally aligned with the upper open ends of the adhesive material dispensing nozzles or orifices 132,134 whereby the adhesive material flow path is completely defined and the adhesive material is able to be dispensed or discharged from the nozzle or die assembly 10. In addition, provided upon the outer sides of each array 128,130 of the adhesive material dispensing nozzles or orifices 132,134, as well as between adjacent ones of the adhesive material dispensing nozzles or orifices 132,134, there is provided a heated air dispensing nozzle or orifice portion 136,138 respectively provided within two similar laterally separated arrays 140, 142 of such heated air dispensing nozzle or orifice portions 136,138, wherein the nozzle or orifice portions 136,138 fluidically cooperate with the apertures or orifices 114,116 as will be discussed hereinafter. Accordingly, each array 140, 142 of heated air dispensing nozzle or orifice portions 136, 138 comprises five heated air dispensing nozzle or orifice portions 136,138.

Referring again to FIG. 2, in connection with the routing or conveyance of the heated air which is to be mixed with the hot melt adhesive material in the well-known or conventional manner, it is seen that each one of the screw bolts 36,36 comprises a reduced diameter shank portion 144. Consequently, when the screw bolts 36,36 are mounted within the nozzle or die assembly 10, heated air can be routed or conveyed to the perimeter region surrounding each reduced diameter shank portion 144,144 of each screw bolt 36,36. Accordingly, with reference again being made to FIG. 3*a*, the second apertures 40,40 defined within the first plate 12 are able to fluidically conduct the heated air therethrough and into the second apertures 62,62 defined within the second plate 14 as seen in FIG. 3*b*. It will be noted that each one of the second apertures 62,62 has vertically elongated apertures 146,146 fluidically connected to opposite sides thereof, and second apertures 64–68 respectively defined within the third, fourth, and fifth plates 16–20 as shown in FIGS. 3*c*–3*e* are provided with similar fluidically connected vertically elongated apertures 148–152. Apertures 146–152 therefore in effect define a continuum which in turn defines a relatively elongated horseshoe-shaped passageway or fluid conduit whereby the heated air can be respectively fluidically conducted through the plates 12–20 by means apertures 40, apertures 62,146, apertures 64,148, apertures 66,150, and apertures 68,152. Beginning with the sixth plate 22, as shown in FIG. 3*f*, vertically oriented apertures 154 are provided within the central portions of the plate 22, and it is seen that such apertures 154 correspond essentially in structure to the lower end portions of the vertically elongated apertures 146–152 of plates 14–20 but are respectively fluidically disconnected from the apertures 70, again for achieving or propagating proper fluid control or fluid flow with desired parameters. In this manner, the heated air fluid from, for example, apertures 152 can be fluidically conducted through apertures 154.

Figure 3H:
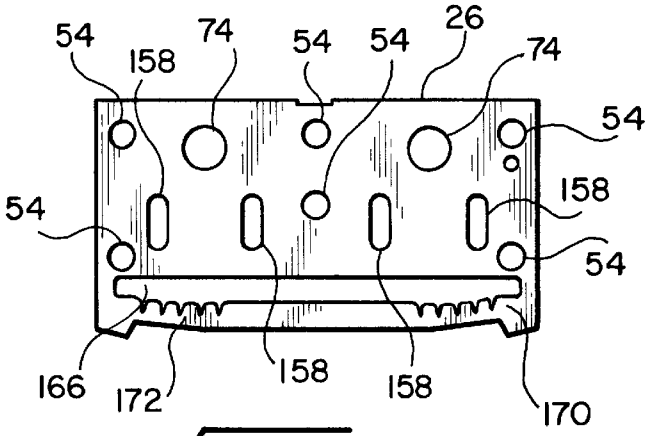
Figure 3E:
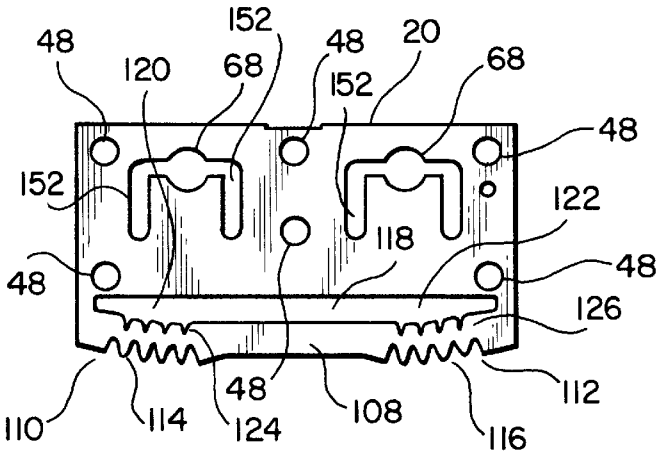
Figure 3G:
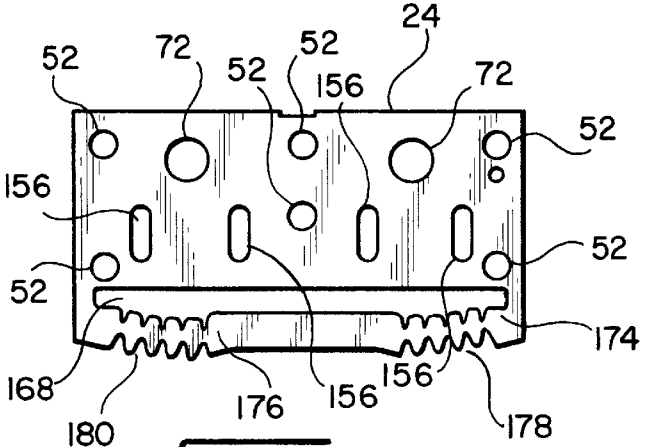
Figure 3J:
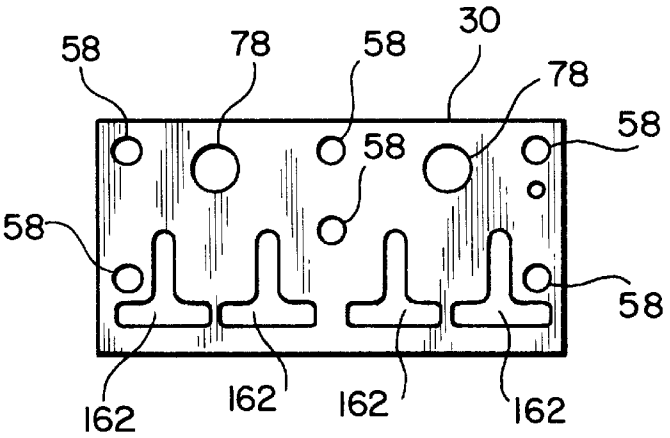
Figure 3K:
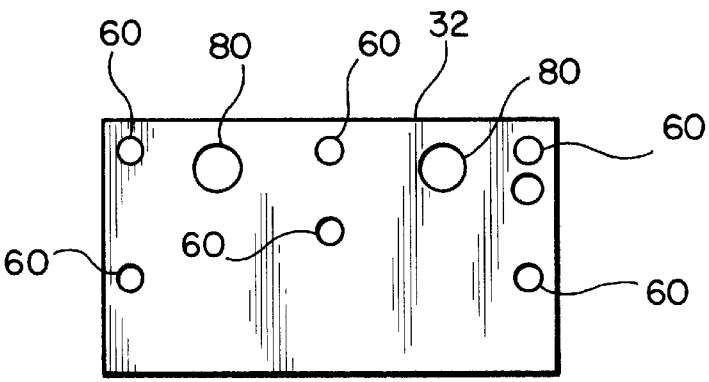
Figure 3I:
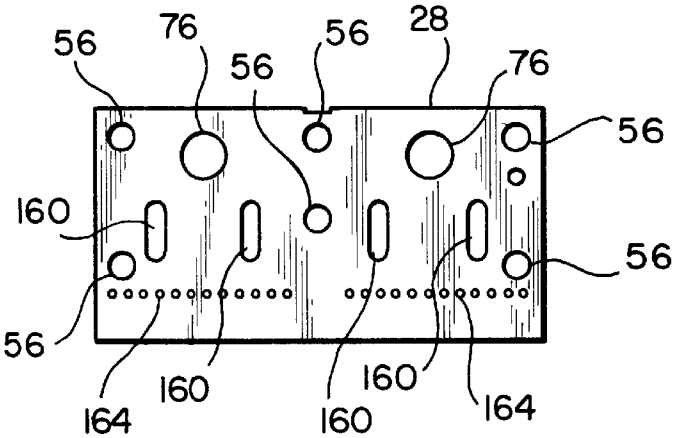

With reference now being made to FIGS. 3*g*–3*i* wherein the seventh, eighth, and ninth plates 24–28 are disclosed, it is seen that central portions of the seventh, eighth, and ninth plates 24–28 similarly comprise vertically oriented elongated apertures 156,158,160 which together with the apertures 154 of the sixth plate 22 define or provide another continuum or fluid flow passageway within the nozzle or die assembly 10 through which the heated air is able to be desirably conducted or conveyed. With reference being additionally made to FIG. 3*j*, it is seen that the tenth plate 30 comprises a plurality, such as, for example, four, of inverted, substantially T-shaped apertures 162 wherein regions of the vertically disposed or oriented portions of the apertures 162 fluidically overlap the vertically oriented apertures 160 of the ninth plate 28 such that the heated air is able to be fluidically conducted into the apertures 162 of the tenth plate 30. Horizontally disposed or oriented portions of the apertures 162 are disposed within lower portions of the tenth plate 30 and are of course fluidically connected to the vertically oriented or disposed portions of the apertures 162. The two central, or second and third, apertures 162,162 of the tenth plate 30 are laterally separated from each other by means of a greater distance than that defined between the first and second apertures, or between the third and fourth apertures, and with reference again being made to FIG. 3*i* it is seen that the lower portion of the ninth plate 28 is provided with a pair of laterally separated arrays of apertures 164. In this manner, the heated air fluidically flowing through apertures 162 of tenth plate 30 is able to be fluidically conducted back through the apertures 164 of the ninth plate 28.

With reference again being made to FIGS. 3*h* and 3*g*, it is seen that the lower portions of the eighth and seventh plates 26,24 are respectively provided with elongated apertures 166 and 168 for fluidically receiving heated air from the lateral arrays of apertures 164,164, and that the lower edge portion of each elongated aperture 166,168 is respectively provided with a pair of laterally separated arrays or series of apertures or orifices 170,172 and 174,176 for fluidically receiving the heated air from the elongated slots 166,168, wherein each series or array of apertures or orifices 170, 172,174,176 comprises five apertures or orifices 170,172, 174,176. It is additionally seen that the lower-most edge portion of the seventh plate 24 is further provided with a pair of laterally separated series or arrays of apertures or orifices 178,180 wherein each series or array of apertures or orifices 178,180 comprises five apertures or orifices, and it is to be appreciated that the apertures or orifices 178,180 correspond to the apertures or orifices 114,116 defined within the fifth plate 20.

In this manner, it can be appreciated that the arrays or sets of five orifices or apertures 170,172,174,176 correspond to the sets or arrays of five heated air dispensing nozzle or orifice portions 136,138 shown in FIG. 3*f* and therefore serve to fluidically supply the heated air to the dispensing nozzle or orifice portions 136,138. From dispensing nozzle or orifice portions 136,138, the heated air flows downwardly through the cooperating apertures or orifices 114,116 defined within the fifth plate 20 as well as through the cooperating apertures or orifices 178,180 defined within the seventh plate 24, it being further appreciated that the apertures or orifices 114 of fifth plate 20, nozzle or orifice portions 136 of sixth plate 22, and apertures or orifices 180 of seventh plate 24 together comprise a first lateral set of five heated air dispensing nozzles, while orifices or apertures 116 of fifth plate 20, nozzle or orifice portions 138 of sixth plate 22, and apertures or orifices 178 of seventh plate 24 together comprise a second lateral set of five heated air dispensing nozzles. As is known in the art, the heated air issuing or dispensed from the heated air dispensing nozzles serves to facilitate the withdrawal of the hot melt adhesive material outwardly from the nozzle or die assembly and to form the same into the hot melt adhesive dispensing streams or filaments. In addition, as can be readily appreciated from FIG. 3*f*, since the arrays or sets of hot melt adhesive dispensing nozzles 128,130 are laterally separated with a void region 182 defined therebetween, a predetermined dispensing pattern can be achieved.

It is lastly to be noted with reference again being made to FIG. 2 that in accordance with the principles and teachings of the present invention, it is seen that a plurality, for example, two, of plates 14,14,22,22, and 30, 30 are utilized within the particular nozzle or die assembly 10, while only single ones of the remaining nozzle or die plates 12,16,18, 20,24,26, and 28 are employed. This duplication of predetermined ones of the nozzle or die plates is for fluid control purposes, and while the particularly noted nozzle or die plates have been duplicated, other nozzle or die plates may be duplicated while only single ones of the noted duplicated nozzle or die plates may be used.

Thus, it may be seen that in accordance with the teachings and principles of the present invention, a new and improved hot melt adhesive dispensing nozzle or die assembly has been developed wherein the nozzle or die assembly spans two adjacent adhesive material valved inlets. One of the valved inlets is blocked off by means of the nozzle or die assembly, while the other adhesive material input or valved inlet is in effect split into two equal laterally separated output arrays of dispensing nozzles so as to provide for a void in the dispensing or deposition pattern at a predeterminedly desired location. The nozzle or die assembly comprises unique structure for ensuring that the hot melt adhesive material is conducted to the remote one of the laterally separated array of dispensing nozzles. In addition, the two laterally separated arrays of output dispensing nozzles together comprise the same number of conventional non-split output dispensing nozzles operatively associated with each adhesive material input or valved inlet such that the volume flow rate through each one of the individual dispensing nozzles remains the same. In this manner, the aforenoted pattern void is achieved while preserving the desired ratio of heated air to adhesive material whereby the hot melt adhesive material being dispensed retains its proper fluidic properties, and undue waste of the adhesive material is not incurred.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A material dispensing nozzle assembly for use in connection with a fluid metering device having laterally separated supply conduits, comprising:

a plurality of plates fixedly secured together and having a predetermined lateral extent which is large enough to span the distance defined between first and second laterally separated supply conduits of a fluid metering device;

a first one of said plurality of plates having at least first and second laterally separated sets of fluid material dispensing nozzles defined therein which define a void therebetween so as to permit dispensing of a first fluid material in first and second laterally separated sets of streams of fluid material with a void defined between the first and second laterally separated sets of streams of fluid material;

a second one of said plurality of plates having an aperture defined therein at a first predetermined location for fluidic communication with the first supply conduit of the fluid metering device so as to permit fluid flow therethrough of the first fluid material from the first supply conduit of the fluid metering device, and having a solid portion defined therein at a second predetermined location so as to block fluid flow of the first fluid material from the second supply conduit of the fluid metering device; and at least a third one of said plurality of plates having fluid flow paths defined therein for conducting fluid material from said aperture fluidically connected to the first supply conduit of the fluid metering device to both of said first and second laterally separated sets of fluid material dispensing nozzles so as to permit dispensing of the first fluid material only from the first supply conduit of the fluid metering device and through both of said first and second laterally separated sets of fluid material dispensing nozzles in first and second laterally separated sets of streams of fluid material with the void defined between the first and second laterally separated sets of streams of fluid material.

2. The material dispensing nozzle assembly as set forth in claim 1, wherein:

said aperture is defined within a first side portion of said second one of said plurality of plates; and said at least a third one of said plurality of plates comprising a substantially triangular aperture defined therein wherein an apex portion of said substantially triangular aperture is fluidically connected to said aperture defined within said second one of said plurality of plates, and a base portion of said substantially triangular aperture extends across said lateral extent of said at least a third one of said plurality of plates from a first side portion thereof to a second side portion thereof so as to distribute the first fluid material along said fluid flow paths extending to said first and second laterally separated sets of fluid material dispensing nozzles.

3. The material dispensing nozzle assembly as set forth in claim 2, wherein:

said aperture is defined within a right side portion of said second one of said plurality of plates; and said base portion of said substantially triangular aperture extends across said lateral extent of said at least a third one of said plurality of plates from a right side portion thereof to a left side portion thereof.

4. The material dispensing nozzle assembly as set forth in claim 1, further comprising:

second fluid flow paths defined within said plurality of plates for conducting a second fluid toward said first and second laterally separated sets of fluid material dispensing nozzles such that the second fluid can intermix with the first fluid.

5. The material dispensing nozzle assembly as set forth in claim 4, wherein:

said first one of said plurality of plates has at least third and fourth laterally separated sets of fluid material dispensing nozzles defined therein for dispensing the second fluid material, conducted to said third and fourth laterally separated sets of fluid material dispensing nozzles by said second fluid flow paths, in third and fourth laterally separated sets of streams of fluid material.

6. The material dispensing nozzle assembly as set forth in claim 5, wherein:

said first and second laterally separated sets of fluid material dispensing nozzles are alternatively disposed with respect to said third and fourth laterally separated sets of fluid material dispensing nozzles such that the first and second fluid materials can intermix with each other.

7. A hot melt adhesive material dispensing nozzle assembly for use in connection with a hot melt adhesive fluid metering device having laterally separated supply conduits, comprising:

a plurality of plates fixedly secured together and having a predetermined lateral extent which is large enough to span the distance defined between first and second laterally separated supply conduits of a hot melt adhesive fluid metering device;

a first one of said plurality of plates having at least first and second laterally separated sets of hot melt adhesive fluid material dispensing nozzles defined therein which define a void therebetween so as to permit dispensing of hot melt adhesive fluid material in first and second laterally separated sets of streams of hot melt adhesive fluid material with a void defined between the first and second laterally separated sets of streams of hot melt adhesive fluid material;

a second one of said plurality of plates having an aperture defined therein at a first predetermined location for fluidic communication with the first supply conduit of the fluid metering device so as to permit fluid flow therethrough of the hot melt adhesive fluid material from the first supply conduit of the fluid metering device, and having a solid portion defined therein at a second predetermined location so as to block fluid flow of the hot melt adhesive fluid material from the second supply conduit of the fluid metering device; and at least a third one of said plurality of plates having fluid flow paths defined therein for conducting hot melt adhesive fluid material from said aperture fluidically connected to the first supply conduit of the fluid metering device to both of said first and second laterally separated sets of hot melt adhesive fluid material dispensing nozzles so as to permit dispensing of the hot melt adhesive fluid material only from the first supply conduit of the fluid metering device and through both of said first and second laterally separated sets of hot melt adhesive fluid material dispensing nozzles in first and second laterally separated sets of streams of hot melt adhesive fluid material with the void defined between the first and second laterally separated sets of streams of hot melt adhesive fluid material.

8. The hot melt adhesive material dispensing nozzle assembly as set forth in claim 7, wherein:

said aperture is defined within a first side portion of said second one of said plurality of plates; and said at least a third one of said plurality of plates comprising a substantially triangular aperture defined therein wherein an apex portion of said substantially triangular aperture is fluidically connected to said aperture defined within said second one of said plurality of plates, and a base portion of said substantially triangular aperture extends across said lateral extent of said at least a third one of said plurality of plates from a first side portion thereof to a second side portion thereof so as to distribute the hot melt adhesive fluid material along said fluid flow paths extending to said first and second laterally separated sets of fluid material dispensing nozzles.

9. The hot melt adhesive material dispensing nozzle assembly as set forth in claim 8, wherein:

said aperture is defined within a right side portion of said second one of said plurality of plates; and said base portion of said substantially triangular aperture extends across said lateral extent of said at least a third one of said plurality of plates from a right side portion thereof to a left side portion thereof.

10. The hot melt adhesive material dispensing nozzle assembly as set forth in claim 7, further comprising:

heated air fluid flow paths defined within said plurality of plates for conducting heated air fluid toward said first and second laterally separated sets of hot melt adhesive material dispensing nozzles such that the heated air fluid can intermix with the hot melt adhesive material.

11. The hot melt adhesive material dispensing nozzle assembly as set forth in claim 10, wherein:

said first one of said plurality of plates has at least third and fourth laterally separated sets of fluid material dispensing nozzles defined therein for dispensing the heated air fluid material, conducted to said third and fourth laterally separated sets of fluid material dispensing nozzles by said second fluid flow paths, in third and fourth laterally separated sets of streams of heated air fluid material.

12. The hot melt adhesive material dispensing nozzle assembly as set forth in claim 11, wherein:

said first and second laterally separated sets of fluid material dispensing nozzles are alternatively disposed with respect to said third and fourth laterally separated sets of fluid material dispensing nozzles such that the hot melt adhesive and heated air fluids can intermix with each other.

13. A hot melt adhesive material dispensing nozzle assembly for use in connection with a hot melt adhesive fluid metering device having laterally separated supply conduits, comprising:

a plurality of plates fixedly secured together and having a predetermined lateral extent which is large enough to span the distance defined between first and second laterally separated supply conduits of a hot melt adhesive fluid metering device;

first and second laterally separated sets of hot melt adhesive fluid material dispensing nozzles defined within said plurality of plates and defining a void therebetween so as to permit dispensing of hot melt adhesive fluid material in first and second laterally separated sets of streams of hot melt adhesive fluid material with a void therebetween; and fluid flow paths defined within said plurality of plates for fluidic communication with the first supply conduit of the fluid metering device and said first and second laterally separated sets of hot melt adhesive fluid material dispensing nozzles so as to permit fluid flow therethrough of the hot melt adhesive fluid material only from the first supply conduit of the fluid metering device to both of said first and second laterally separated sets of hot melt adhesive fluid material dispensing nozzles so as to permit dispensing of the hot melt adhesive fluid material in first and second laterally separated sets of streams of hot melt adhesive fluid material with the void defined therebetween.

14. The hot melt adhesive material dispensing nozzle assembly as set forth in claim 13, wherein:

an aperture is defined within a first side portion of one of said plurality of plates for fluidic connection to the first supply conduit; and said fluid flow paths comprise a substantially triangular aperture defined within another one of said plurality of plates wherein an apex portion of said substantially triangular aperture is fluidically connected to said aperture defined within said one of said plurality of plates, and a base portion of said substantially triangular aperture extends across said lateral extent of said another one of said plurality of plates from a first side portion thereof to a second side portion thereof so as to distribute the hot melt adhesive fluid material along said fluid flow paths extending to said first and second laterally separated sets of fluid material dispensing nozzles.

15. The hot melt adhesive material dispensing nozzle assembly as set forth in claim 14, wherein:

said aperture is defined within a right side portion of said second one of said plurality of plates; and said base portion of said substantially triangular aperture extends across said lateral extent of said at least a third one of said plurality of plates from a right side portion thereof to a left side portion thereof.

16. The hot melt adhesive material dispensing nozzle assembly as set forth in claim 13, further comprising:

heated air fluid flow paths defined within said plurality of plates for conducting heated air fluid toward said first and second laterally separated sets of hot melt adhesive material dispensing nozzles such that the heated air fluid can intermix with the hot melt adhesive material.

17. The hot melt adhesive material dispensing nozzle assembly as set forth in claim 16, wherein:

said plurality of plates have at least third and fourth laterally separated sets of fluid material dispensing nozzles defined therein for dispensing the heated air fluid material, conducted to said third and fourth laterally separated sets of fluid material dispensing nozzles by said heated air fluid flow paths, in third and fourth laterally separated sets of streams of heated air fluid material.

18. The hot melt adhesive material dispensing nozzle assembly as set forth in claim 17, wherein:

said first and second laterally separated sets of fluid material dispensing nozzles are alternatively disposed with respect to said third and fourth laterally separated sets of fluid material dispensing nozzles such that the hot melt adhesive and heated air fluids can intermix with each other.

19. In combination, a hot melt adhesive material dispensing nozzle assembly for use in connection with a hot melt adhesive fluid metering device having laterally separated supply conduits, comprising:

first and second supply conduits of a hot melt adhesive fluid metering device separated from each other by means of a predetermined distance;

a plurality of plates fixedly secured together and having a predetermined lateral extent which is large enough to span said distance defined between said first and second laterally separated supply conduits of said hot melt adhesive fluid metering device;

first and second laterally separated sets of hot melt adhesive fluid material dispensing nozzles defined within said plurality of plates and defining a void therebetween so as to permit dispensing of hot melt adhesive fluid material in first and second laterally separated sets of streams of hot melt adhesive fluid material with a void therebetween; and fluid flow paths defined within said plurality of plates for fluidic communication with said first supply conduit of said fluid metering device and said first and second laterally separated sets of hot melt adhesive fluid material dispensing nozzles so as to permit fluid flow therethrough of the hot melt adhesive fluid material only from said first supply conduit of said fluid metering device to both of said first and second laterally separated sets of said hot melt adhesive fluid material dispensing nozzles so as to permit dispensing of the hot melt adhesive fluid material in first and second laterally separated sets of streams of hot melt adhesive fluid material with the void defined therebetween.

20. The combination as set forth in claim 19, wherein:

an aperture is defined within a first side portion of one of said plurality of plates for fluidic connection to said first supply conduit; and said fluid flow paths comprise a substantially triangular aperture defined within another one of said plurality of plates wherein an apex portion of said substantially triangular aperture is fluidically connected to said aperture defined within said one of said plurality of plates, and a base portion of said substantially triangular aperture extends across said lateral extent of said another one of said plurality of plates from a first side portion thereof to a second side portion thereof so as to distribute the hot melt adhesive fluid material along said fluid flow paths extending to said first and second laterally separated sets of fluid material dispensing nozzles.

21. The combination as set forth in claim 20, wherein:

said aperture is defined within a right side portion of said second one of said plurality of plates; and said base portion of said substantially triangular aperture extends across said lateral extent of said at least a third one of said plurality of plates from a right side portion thereof to a left side portion thereof.

22. The combination as set forth in claim 19, further comprising:

heated air fluid flow paths defined within said plurality of plates for conducting heated air fluid toward said first and second laterally separated sets of hot melt adhesive material dispensing nozzles such that the heated air fluid can intermix with the hot melt adhesive material.

23. The combination as set forth in claim 22, wherein:

said plurality of plates have at least third and fourth laterally separated sets of fluid material dispensing nozzles defined therein for dispensing the heated air fluid material, conducted to said third and fourth laterally separated sets of fluid material dispensing nozzles by said heated air fluid flow paths, in third and fourth laterally separated sets of streams of heated air fluid material.

24. The combination as set forth in claim 23, wherein:

said first and second laterally separated sets of fluid material dispensing nozzles are alternatively disposed with respect to said third and fourth laterally separated sets of fluid material dispensing nozzles such that the hot melt adhesive and heated air fluids can intermix with each other.

25. A hot melt adhesive material dispensing nozzle assembly for use in connection with a hot melt adhesive fluid metering device having a supply conduit, comprising:

a plurality of plates fixedly secured together wherein a first one of said plates is adapted to be fluidically connected to the supply conduit of the hot melt adhesive fluid metering device;

first and second laterally separated sets of hot melt adhesive fluid material dispensing nozzles defined within said plurality of plates and defining a void therebetween so as to permit dispensing of hot melt adhesive fluid material in a pattern comprising first and second laterally separated sets of streams of hot melt adhesive fluid material with a void therebetween; and fluid flow paths defined within said plurality of plates for fluidic communication with the supply conduit of the fluid metering device and said first and second laterally separated sets of hot melt adhesive fluid material dispensing nozzles so as to permit fluid flow therethrough of the hot melt adhesive fluid material only from the supply conduit of the fluid metering device to both of said first and second laterally separated sets of hot melt adhesive fluid material dispensing nozzles so as to permit dispensing of the hot melt adhesive fluid material in first and second laterally separated sets of streams of hot melt adhesive fluid material with the void defined therebetween.

26. The hot melt adhesive material dispensing nozzle assembly as set forth in claim 25, wherein:

an aperture is defined within a first side portion of said first one of said plurality of plates for fluidic connection to the supply conduit; and said fluid flow paths comprise a substantially triangular aperture defined within another one of said plurality of plates wherein an apex portion of said substantially triangular aperture is fluidically connected to said aperture defined within said first one of said plurality of plates, and a base portion of said substantially triangular aperture extends across said lateral extent of said another one of said plurality of plates from a first side portion thereof to a second side portion thereof so as to distribute the hot melt adhesive fluid material along said fluid flow paths extending to said first and second laterally separated sets of fluid material dispensing nozzles.

27. The hot melt adhesive material dispensing nozzle assembly as set forth in claim 26, wherein:

said aperture is defined within a right side portion of said second one of said plurality of plates; and said base portion of said substantially triangular aperture extends across said lateral extent of said at least a third one of said plurality of plates from a right side portion thereof to a left side portion thereof.

28. The hot melt adhesive material dispensing nozzle assembly as set forth in claim 25, further comprising:

heated air fluid flow paths defined within said plurality of plates for conducting heated air fluid toward said first and second laterally separated sets of hot melt adhesive material dispensing nozzles such that the heated air fluid can intermix with the hot melt adhesive material.

29. The hot melt adhesive material dispensing nozzle assembly as set forth in claim 28, wherein:

said plurality of plates have at least third and fourth laterally separated sets of fluid material dispensing nozzles defined therein for dispensing the heated air fluid material, conducted to said third and fourth laterally separated sets of fluid material dispensing nozzles by said heated air fluid flow paths, in third and fourth laterally separated sets of streams of heated air fluid material.

30. The hot melt adhesive material dispensing nozzle assembly as set forth in claim 28, wherein:

said first and second laterally separated sets of fluid material dispensing nozzles are alternatively disposed with respect to said third and fourth laterally separated sets of fluid material dispensing nozzles such that the hot melt adhesive and heated air fluids can intermix with each other.

* * * * *